United States Patent [19]

Farmer

[11] Patent Number: 4,791,857

[45] Date of Patent: Dec. 20, 1988

[54] AIR VALVE PUSH BUTTON ADAPTER

[76] Inventor: Frederick M. Farmer, 4364 Real Ct., Orlando, Fla. 32808-2230

[21] Appl. No.: 99,299

[22] Filed: Sep. 17, 1987

[51] Int. Cl.[4] ..... F12B 19/00

[52] U.S. Cl. ..... 92/98 R; 251/57; 92/169

[58] Field of Search ..... 251/57; 137/360, 359; 200/81 H; 411/539, 542, 531, 368, 369, 370; 92/169, 98 R; 60/533

[56] References Cited

U.S. PATENT DOCUMENTS

| | | | |
|---|---|---|---|
| 2,959,186 | 11/1960 | McClenahan | 137/360 |
| 4,630,644 | 12/1986 | Hafner | 251/57 X |
| 4,682,533 | 7/1987 | Hafner | 92/169 X |

*Primary Examiner*—Alan Cohan

[57] ABSTRACT

An adapter for mounting a diaphragm-type push button control, for remote actuation of a water metering valve, to countertops or lavatories of various thicknesses and through openings having various diameters has a circular cap portion with a diameter greater than the largest opening diameter and a threaded cylindrical shank portion concentric with the cap portion. The diameter of the shank portion is slightly less than the diameter of the smallest opening and the length of the shank is greater than the greatest thickness of the countertops or lavatories. A faucet washer and nut having a diameter greater than the largest opening are threaded onto the shank. An end of the shank has a pipe thread to permit attachment of the push button control thereto. A cylindrical push rod is disposed through a concentric opening in the cap and shank portions with a push button portion thereof extending from a first end and from the cap portion. A second end rests on the diaphragm of the push button control. Depressing the push button portion thereby actuates the diaphragm to produce a pulse of air.

4 Claims, 1 Drawing Sheet

AIR VALVE PUSH BUTTON ADAPTER

BACKGROUND OF THE INVENTION

1. Field of the Invention

The present invention relates to air operated water metering valve systems, and more particularly to a universal adapter permitting an air-type push button control to be mounted in any fixture.

2. Description of the Prior Art

The use of pneumatic water metering valves in public lavatories and washrooms is well known. Such valves are mounted in the lavatory fixture and are actuated by a push button type control which, when operated, depresses an air diaphragm connected to the metering valve. A pulse of air pressure opens the valve causing a preselected amount of water to flow into the lavatory. It is also known to gang a plurality of pneumatic water metering valves in group washing systems such as used in factories and large office lavatories. Here, a common lavatory basin may have a plurality of water spouts and of hand and foot operated push buttons such that a number of workers can use the facility at one time.

A representative metering valve and push button system is described in detail in U.S. Pat. No. 4,630,644 to Haffner et al and assigned to Acorn Engineering Company. Commercially available push button devices available from Acorn Engineering Company are designed to be mounted through thin metal panels such as stainless steel. Thus, such push button devices cannot be used with conventional lavatory fixtures having relatively thick walls or through countertops formed from plywood, marble or the like.

It has been proposed that a significant cost saving can be realized, through the use of this type of metering valves, in construction of washrooms having long counters with multiple lavatories mounted therein such as are common in airports, schools, and other public and private buildings. Such proposal suggests mounting a plurality of water metering valves ganged together in an accessible closet or wall space having a single cold water line and a single hot water line plumbed into the ganged valves. Relatively small flexible plastic lines would carry the hot and cold water from the location of the ganged valves to each of the lavatories along an extended counter. A diaphragm type push button device would be mounted for each of the ganged valves at the respective lavatories and connected to the respective valves by plastic tubing. Thus, there is a need for a universal adapter that can be attached to existing and available air-type push button control bodies and which can be mounted through materials of various thicknesses having openings of various sizes.

SUMMARY OF THE INVENTION

The present invention is a universal adapter that will mount through holes of varying diameters and through counters or fixtures of varying thicknesses. The adapter includes a cap portion which may have a diameter on the order of 2 to 3 inches, and a shank having a diameter slightly smaller than the smallest opening with which the unit will be used. The shank has an axial circular hole through its length. A shank diameter of 1⅛ inches will accommodate the majority of american fixtures. The length of the shank is selected in accordance with the thickest deck or counter anticipated. For example, 1¾ to 2 inches is suitable. The shank is threaded over its full length to accept a standard flat water faucet nut. A washer having a central opening to clear the diameter of the shank and having a diameter at least equal to the diameter of the adapter head portion is disposed between the nut and counter. As will be recognized, the adapter will fit openings from its own diameter out to diameters limited by the diameter of the head portion. A plurality of ring-like spacers of varying outside diameters may be furnished with the adapter in which each outside diameter is equal to a different standard opening size. Such spacer is used for maintaining the assembly centered.

At the end of the shank opposite from the head portion, an external pipe thread is provided which will fit a standard hand operated diaphragm-type push button assembly housing such as shown in FIG. 11 of the Haffner et al patent. Prior to attaching the adapter to the push button housing, an elongated push button rod of nylon material or the like is inserted through the axial hole of the shank such that one end projects through the head portion of the adapter and the opposite end is flush with the end of the pipe thread portion. When the adapter is installed in a fixture or through a countertop, the push button rod is inserted and the push button assembly housing is threaded onto the pipe thread portion of the adapter. The push button contacts the diaphragm which will, through its resilience, maintain the push button portion or the rod extended from the head portion of the adapter. Thus, when the extended push button portion is depressed, the diaphragm will be depressed, sending a pulse of air to the metering valve, and thereby produce the desired metered flow of water. As will now be recognized, a universal adapter for use with a push button type diaphragm air control has been described which will fit a wide variety of countertop or fixture openings as well as thicknesses.

It is therefore a principal object of the invention to provide a universal adapter which is attachable to commercially available diaphragm-type air control devices and which can be installed in openings through counters and lavatory fixtures having a wide range of opening diameters therethrough and thicknesses.

It is another object of the invention to provide a simple low cost adapter to eliminate the expense of custom designed push button air control devices.

These and other objects and advantages of the invention will become apparent from the following detailed description when read in conjunction with the drawings.

DETAILED DESCRIPTION OF THE PREFERRED EMBODIMENT

Figure 1:
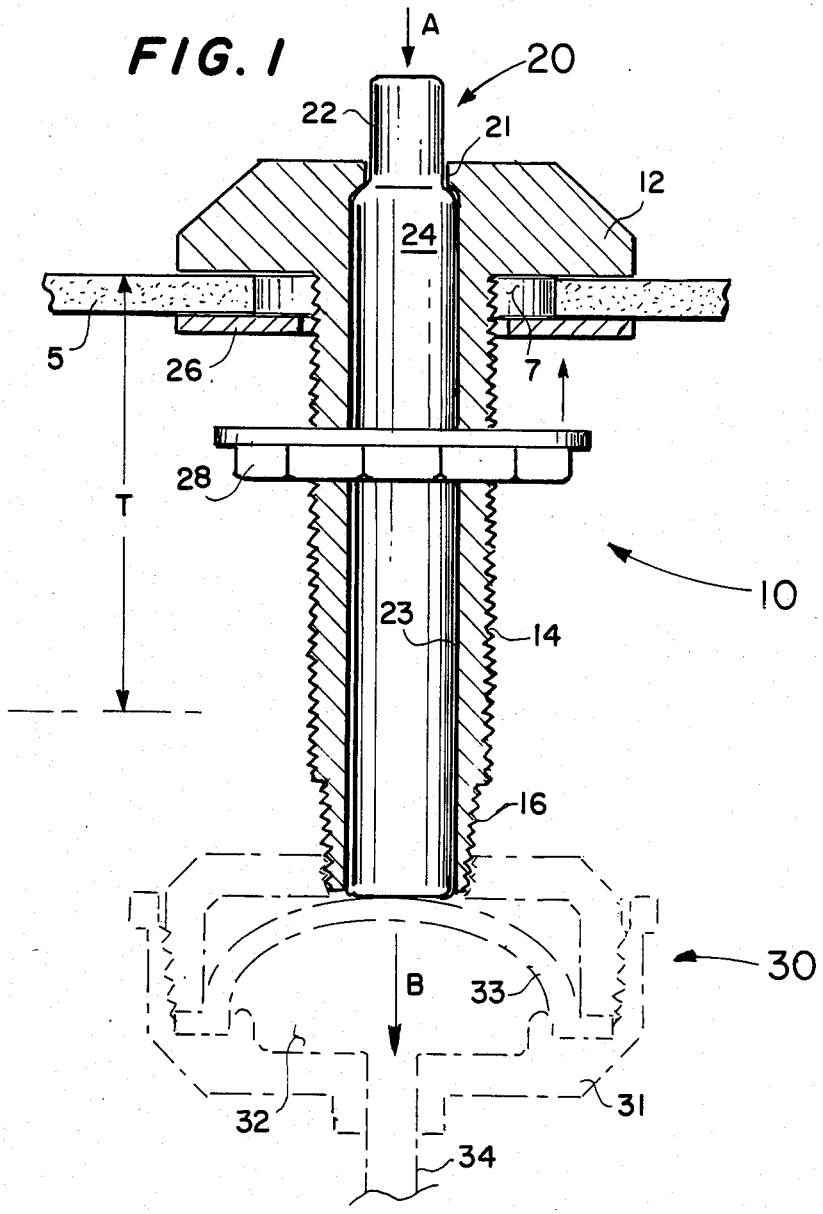
FIG. 1 shows a cross-sectional view of the adapter of the invention installed in a countertop or the like and having an air diaphragm push button device, shown in phantom view, attached thereto.

Referring to FIG. 1, a surface 5 through which a pneumatic push button control device is to be mounted is shown. Surface 5 may have a circular opening 7 therethrough. Surface 5 may represent a countertop or a lavatory fixture having a thickness thereof of any desired valve up to a value T as shown. Typically, the thickness of surface 5 may be small such as for sheet metal, of medium thickness such as in ceramic or metal faucet fixtures and lavatory basins, or very thick when a plywood or marble countertop is used.

A push button adapter assembly 10 having a cap portion 12 and a threaded shank portion 14 is inserted through opening 7 with a washer 26 and nut 28 utilized to securely clamp assembly 10 in place. Cap portion 12 and washer 26 have outside diameters selected to accommodate the largest anticipated diameter of opening 7.

Shank portion 14 and cap portion 12 have an axial cylindrical hole 23 therethrough to accept a cylindrical push button rod 20, which may be fabricated from nylon, metal or other suitable material. Push button rod 20 has a shank portion 24 forming a sliding fit in hole 23. At the upper end of rod 20, a button portion 22 is provided having a reduced diameter from that of shank portion 24 thereby forming a shoulder therebetween. Button portion 22 projects through cylindrical opening 21 which is smaller in diameter than axial hole 23 to captivate push button rod 20.

At the lower end of shank 14, a reduced diameter portion 16 thereof is provided with a male tapered pipe thread, preferably a National Pipe Thread type, to match the female threads of the diaphragm and housing assembly 30 (shown in phantom view) of a commercially available hand-operated push button control for a remote control air operated metering valve. Assembly 30 may be of the type shown in FIG. 11 of U.S. Pat. No. 4,630,644 with the original push button assembly removed. Suitable units are manufactured by Acorn Engineering Company of City of Industry, Calif. Assembly 30 is screwed onto threaded portion 46 such that the lower end of push button rod 20 contacts resilient diaphragm 33 and is held in position with button portion 22 fully extended from cap portion 12.

Assembly 10 includes an outlet line 34 which extends to a remotely located metering valve. When button portion 22 is depressed as at A, diaphragm 33 moves as shown by arrow B to transmit a pulse of air through line 34 to energize the remote metering valve. When button portion 22 is released, it is returned to the extended position by diaphragm 33.

Figure 2:
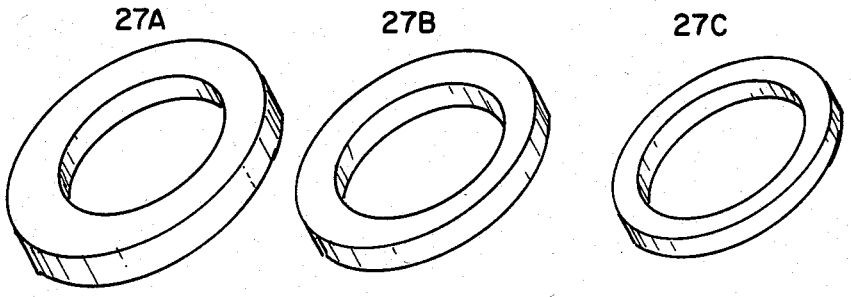
FIG. 2 shows a set of spacer centering rings for use with the adapter of FIG. 1.

Although not shown in FIG. 1, a spacer ring may be utilized to center push button adpater 10. For example, FIG. 2 illustrates a plurality of spacer rings 27 which may be furnished with a push button adapter 10. Each ring 27A, 27B and 27C has an inside diameter to fit over shank 14 and an outside diameter to fit standard size plumbing openings. The selected ring 27 serves to maintain the assembly centered in opening 7.

Although a specific design of the push button adapter of the invention is disclosed, it is to be understood that it is for exemplary purposes only and various changes in diameters and lengths may be made without departing from the spirit and scope of the invention.

I claim:

1. An adapter for mounting a diaphragm-type push button control, for remote actuation of a water metering valve to countertops or lavatories having a range of thicknesses and through openings having a range of diameters, said control having a threaded opening comprising:

a circular cap portion having a diameter greater than the maximum of said range of diameters;

a threaded cylindrical shank concentrically attached at a proximal end thereof to said cap portion, said cap portion and said shank having a cylindrical axial opening therethrough, a distal end of said shank having a reduced diameter portion threaded to fit said threaded opening of said control for attaching said shank to said control, said shank having a length greater than the maximum of said range of thicknesses;

a faucet nut having a diameter greater than the maximum of said range of diameters threadably disposed on said threaded shank;

a centering ring disposed on said shank for centering said shank in an opening; and a rod disposed in said axial opening having a push button portion on a first end thereof extending from said cap portion and a second end bearing on a diaphragm in said control when said distal end of said shank is attached to said control whereby pushing of said push button portion depresses said diaphragm.

2. The adapter as recited in claim 1 which further includes a washer disposed on said shank between said faucet nut and said cap portion.

3. The adapter as recited in claim 1 in which said axial opening through said cap portion has a smaller diameter than said rod; and said first end of said rod has a reduced diameter sightly less than said smaller diameter axial opening.

4. A universal push button assembly for mounting a diaphragm type control and for producing a pulse of air pressure from said control to operate a remote water metering valve when a push button portion of said assembly is depressed, said assembly to be installed in countertops or lavatories having openings therethrough of various diameters and thicknesses of various amounts, said assembly comprising (a) a body having (i) a circular cap having a diameter greater than the largest diameter of a range of said opening diameters, (ii) a cylindrical shank concentric with and attached at a proximal end thereof to said cap, said shank having a diameter less than the smallest of said range of said opening diameters, and a length greater than the largest of said thicknesses, said shank threaded over its length, (iii) a threaded nipple at a distal end of said shank for attachment to said diaphragm type control, (iv) said body having an axial cylindrical opening through said cap, said shank and said nipple;

(b) a centering ring disposed on said shank for centering said shank in an opening; and (c) a cylindrical push rod disposed through said axial opening, said rod having a first end thereof having a reduced diameter push button portion projecting from said cap and a second end thereof contacting a diaphragm of said control.

* * * * *